US008402567B2

(12) United States Patent
Agassi et al.

(10) Patent No.: US 8,402,567 B2
(45) Date of Patent: Mar. 26, 2013

(54) CONCEALING UNDERGARMENT

(76) Inventors: Phillip Agassi, Las Vegas, NV (US); Marti Agassi, Las Vegas, NV (US)

( * ) Notice: Subject to any disclaimer, the term of this patent is extended or adjusted under 35 U.S.C. 154(b) by 797 days.

(21) Appl. No.: 12/584,800

(22) Filed: Sep. 10, 2009

(65) Prior Publication Data

US 2011/0059678 A1 Mar. 10, 2011

(51) Int. Cl.
*A41B 9/00* (2006.01)
*A41B 9/04* (2006.01)

(52) U.S. Cl. ..... 2/400; 2/406

(58) Field of Classification Search ..... 2/400, 403, 2/406, 271, 217; 450/5, 7, 8, 12–15, 16, 450/31–33; 66/172 E, 172 R, 171
See application file for complete search history.

(56) References Cited

U.S. PATENT DOCUMENTS

| | | | | | |
|---|---|---|---|---|---|
| 2,584,556 | A * | 2/1952 | Cousins | 450/95 |
| 2,587,911 | A * | 3/1952 | Sider | 450/14 |
| 3,185,156 | A * | 5/1965 | Steinberger | 450/14 |
| 3,292,629 | A * | 12/1966 | Steinberger | 450/15 |
| 3,327,714 | A * | 6/1967 | Steinberger | 450/14 |
| 4,202,343 | A * | 5/1980 | Ichelson | 450/14 |
| 5,515,542 | A * | 5/1996 | Simmons | 2/67 |
| 5,590,548 | A * | 1/1997 | Osborne | 66/177 |
| 6,138,282 | A * | 10/2000 | Follese | 2/400 |
| 7,024,892 | B2 * | 4/2006 | Blakely | 66/177 |
| 2005/0172382 | A1 | 8/2005 | Masterson | |

OTHER PUBLICATIONS

Knowledge@Emory, "For Spanx, The Trifecta of Culture, Creativity and Quality is a Winning Combination", Published Feb. 14, 2008 in Knowledge@Emory, 2 pages.

* cited by examiner

*Primary Examiner* — Gloria Hale
(74) *Attorney, Agent, or Firm* — Weide & Miller, Ltd.

(57) ABSTRACT

A concealing undergarment preserves a user's modesty while allowing the user to wear modern apparel such as low-slung or low-cut pants, jeans, and the like. In general, the concealing undergarment conceals parts of the user's body which may be revealed due to the style or cut of apparel the user is wearing. The concealing undergarment may have the appearance of skin when worn. This allows the user to wear more revealing styles, as intended. The concealing undergarment may conceal the user's midriff and back while preventing rear cleavage from being seen, especially where the user is wearing low-slung pants or jeans. An extension may be provided to present inspirational phrases, positive words, facts, and other information to a user. The extension may be tucked under the user's bra to be close to the user's heart, and be used to hold an upper portion of the concealing undergarment in position.

12 Claims, 6 Drawing Sheets

CONCEALING UNDERGARMENT

BACKGROUND OF THE INVENTION

1. Field of the Invention

The invention relates generally to undergarments and in particular to a concealing undergarment allowing a wearer to wear modern and popular clothing with comfort, confidence, and modesty.

2. Related Art

A current style trend in women's fashion is low-rise jeans and pants. This influence is seen throughout female fashions ranging in age from 13 to 50. Women in these age ranges are wearing tight, low-cut, figure-hugging jeans, pants, and other bottoms. The low-cut trend started in the mid 1990's and waist lines have since progressively edged lower exposing the abdominal area, lower back, and sides. As this trend has progressed, it has become less likely for women's tops to cover these areas.

Low-cut bottoms present another problem in that they tend to cause or exacerbate the appearance of a bulge, also known as "love handles", at the waistline. Love handles materialize on even the thinnest of women because the waistline of pants, jeans, or other bottoms surround a woman's body at its fleshiest point—just below the hips, at the buttocks. The appearance of love handles is widely considered unflattering. In addition the skin in this area may also exhibit imperfections.

Women who want to be stylish are thus inconvenienced, sacrificing comfort and modesty for the sake of style. In addition, women must either reject the style or accept flaunting their perceived imperfections. This may also cause mental anxiety. In the case of jeans for example, this can be a difficult choice given that jeans are a mainstream classic style that is accepted from casual to dressy occasions. To illustrate, in 2007, the Alexander Report stated that American consumers purchase approximately 450 million pairs of jeans per year and that denim was a 10 billion dollar industry in the U.S. Though consumers have generally become more price-conscious, fit and style still drive jeans and other apparel purchases more than any other factor.

From the discussion that follows, it will become apparent that the present invention addresses the deficiencies associated with the prior art while providing numerous additional advantages and benefits not contemplated or possible with prior art constructions.

SUMMARY OF THE INVENTION

The concealing undergarment covers portions of a user's body allowing even a modest user to wear modern, and more revealing, apparel. In general, the concealing undergarment prevents skin of the user's midriff and back from becoming exposed. In addition, the concealing undergarment may be configured to prevent rear cleavage from being seen. The concealing undergarment appears to be the user's skin and thus is ideal because other people do not become aware of the undergarment. In this manner, the user can be confident when wearing various styles and modern low-slung or low-slung pants, jeans, and the like without worrying that the user's actual skin will be revealed. The concealing undergarment also has features that provide psychological benefits and practical benefits which will become apparent from the description herein.

In one embodiment, the concealing undergarment comprises a front section comprising a tapered bottom portion, an upper portion, and two sides. The back section may comprise a tapered bottom portion, an upper portion, and two sides as well. The tapered bottom portion of the front section and the tapered bottom portion of the back may be connected at a bottom end of the concealing undergarment to form a crotch section. The front section and the back section may be connected at their sides. In addition, the back section may comprise a material which simulates the appearance of skin.

A torso opening configured to accept a torso of a user may also be provided. The torso opening may be formed at a top end of the concealing undergarment between the upper portion of the front section and the upper portion of the back section. A pair of leg openings formed at a bottom end of the concealing undergarment between the crotch section and the sides of the front section and back section may be used to accept one or more legs of a user. In this manner, the user may wear the concealing undergarment.

The concealing undergarment may also include an extension having a tapered shape extending upward from the upper portion of the front section. One or more straps may extend from the extension to attach to a user's bra preventing the concealing undergarment from slipping down the user's torso. It is noted that the straps may also extend upward from the upper portion of the front section. In some embodiments, a bra may be included to secure the upper portion of the front section in position and keep the concealing undergarment from slipping down the user's torso.

Typically, the extension will have a symbol area with one or more symbols thereon. The one or more symbols may form one or more phrases such as inspirational quotes, inspirational sayings, or affectionate words. These provide a psychological benefit to the user when they are viewed. It is contemplated that a symbol area may also be located on the upper portion of the concealing undergarment. In these embodiments, the extension, if provided, may or may not provide its own inspirational phrase or phrases.

For example, the symbol area may be on a back portion of the extension so that the one or more symbols in the symbol area are visible to a user when the concealing undergarment is put on or taken off. It is noted that the symbol area may also or alternatively be on the back portion of the extension to provide a continued psychological benefit to the user because the one or more symbols in the symbol area are in physical contact with the user's body when the concealing undergarment is worn.

The concealing undergarment may also have a simulated tattoo configured to conceal an area of the user's skin. The simulated tattoo may be located on the back section. The simulated tattoo of one embodiment may be a butterfly having a body and a pair of extended wings. The body covers rear cleavage when over the rear cleavage while the pair of extended wings covers the rear cleavage when the body is not over the rear cleavage because of movement by the user.

In one embodiment, a method of concealing a user's body with a concealing undergarment is provided. The method may comprise accepting the user's legs through one or more leg openings at a bottom end of the concealing undergarment, and accepting the user's torso through a torso opening at a top end of the concealing undergarment. One or more symbols may be to the user in a symbol area on an extension of the concealing undergarment, and the extension may be tucked under the user's bra to hold the top end in position. Once tucked, the one or more symbols touch the user's torso to provide a psychological benefit to the user.

A user's midsection is concealed with the concealing undergarment which may comprise a material that simulates the appearance of skin. In addition, the concealing undergarment prevents adjustments the user has to make to position the user's apparel to conceal the user's body from view.

The method may include constricting the user's midsection to prevent the appearance of one or more bulges at the user's waist. In addition, the method may include improving the user's mood when the user is putting on or taking off the concealing undergarment by presenting one or more positive phrases to the user through the one or more symbols on an extension of the concealing undergarment. The user may also be informed when the user is putting on or taking off the concealing undergarment such as by presenting one or more facts through the symbols.

A user's rear cleavage may be concealed with one or more simulated tattoos on the concealing undergarment. The tattoo may be changed by selecting a concealing undergarment having a desired simulated tattoo for wear. The simulated tattoo may be selected from a selection of simulated tattoos and attached to the concealing undergarment through heat applied by the user.

In one embodiment, a method of improving the appearance of low-slung apparel with a concealing undergarment is provided. The method may comprise accepting a user in the concealing undergarment by receiving one or more legs of the user in one or more leg openings of the concealing undergarment, where a torso of the user extends out from a torso opening of the concealing undergarment. The concealing undergarment may be form fitting to provide the illusion that the concealing undergarment is the user's skin.

One or more symbols may be presented on a symbol area to the user, the symbol area located on an extension of an upper front portion of the concealing undergarment. In this way, the user views the one or more symbols when taking off the concealing undergarment and putting on the concealing undergarment. The one or more symbols may form a plurality of inspirational phrases to inspire the user. A large quantity of inspirational phrases may be provided to allow the user to continuously discover new inspirational phrases in the plurality of inspirational phrases.

The method may also include accepting the user's lower body in the low-slung apparel having a top edge, and accepting the user's upper body in a top having a bottom edge. The concealing undergarment may then conceal the user's midriff between the top edge and the bottom edge with a first portion of the concealing undergarment. Also, the user's back between the top edge and the bottom edge may be concealed with a second portion of the concealing undergarment. The first portion and second portion may be configured to appear to be skin of the user.

Rear cleavage may be concealed in various ways. For example, rear cleavage may be concealed with one or more simulated tattoos on a back section of the concealing undergarment as the top edge of the low-slung apparel moves downward because of the user's movements. The rear cleavage may also be concealed with one or more simulated tattoos on a back section of the concealing undergarment as the bottom edge of the top moves upward because of a user's movement.

Steps may be taken to prevent the concealing undergarment from moving down a user's torso in various ways. For example, the upper front portion of the concealing undergarment may be secured in place by tucking the extension under a bra, or by attaching one or more ties extending from the extension to a bra. The upper front portion of the concealing undergarment may also be secured to the user's torso with an elastic binding on the extension.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the concealing undergarment provided herein is configured to provide the wearer comfort, confidence, and modesty during life's daily activities. This allows the wearer to wear modern and popular styles which may be more revealing. The concealing undergarment may be worn by users who do not consider themselves body perfect, which is a vast number of people.

The concealing undergarment was designed as a fashionable, yet discrete way to conceal unwanted skin exposure. Since, as stated, the fashion trend for the last 15 years has been progressively lower-slung or lower-rise bottoms, it has become quite difficult or impossible to bend and sit comfortably without unwanted skin exposure. The concealing undergarment is directed to enhancing its user's confidence to feel free to participate in life's activities and adventures, and to allow its users to enjoy life now, not five pounds from now.

This allows users of the concealing undergarment to wear today's fashions while concealing their flaws.

Users who have a desire for modesty, yet enjoy wearing the current trend of low-rise fashions will benefit from the concealing undergarment. Users of various shapes and sizes, who feel their figure is less than perfect due to weight, scars or stretch marks can reduce the appearance of these perceived imperfections simply by wearing the concealing undergarment. In addition, as will be discussed further below, the concealing undergarment may be configured with faux tattoo which give the appearance of a tattoo with out the pains, cost, and permanence. Socio-economic levels are not limited to any population due to the low cost of the product.

Figure 1A:
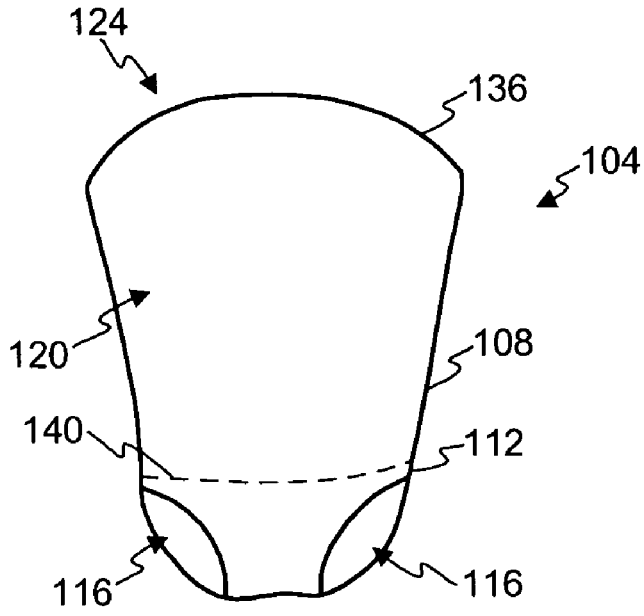
FIG. 1A is a front view of an exemplary concealing undergarment.

The concealing undergarment will now be described with regard to FIG. 1A, which is a front view of the concealing undergarment 104, and FIG. 1B which is a back view of the concealing undergarment. In one or more embodiments, the concealing undergarment 104 comprises a front 120, a back 128. It is noted that the dashed indicator 140 is provided in the figures to aid in the description herein by delineating an upper portion 108 and a lower portion 112 of the concealing undergarment 104. As such, the dashed indicator will not be visible or be an element of the concealing undergarment 104 in typical embodiments.

As can be seen, a lower portion 112 of the front 120 and back 128 may have be shaped or tapered to form a pair of leg openings 116 at the bottom of the concealing undergarment 104. The tapered portions of the front 120 and back 128 may be connected to form a crotch section 148 between the leg openings 116. The front 120 and back 128 may be connected along their sides to form the concealing undergarment 104.

The front 120 and back 128 are not connected at the top end of the concealing undergarment 104 to form a torso opening 124 at an upper portion 108 of the concealing undergarment. The torso opening 124 and leg openings 116 allow a user to wear the concealing undergarment 104 around the pelvic area, waist and torso and help keep the concealing undergarment in place when worn. The front portion 120 may have an extension 136 at its top in one or more embodiments, which will be described further below. The back 128, front, and other areas may have one or more simulated tattoos 132, or other markings which will also be described further below.

It is noted that the front 120, back 128, upper portion 108, and lower portion 112 are used herein to describe sections of the concealing undergarment 104. Thus, one or more materials may be used to form these sections. For example, in a "seamless" embodiment, sections of the concealing undergarment 104 may all be formed from a single piece of material. In other embodiments, one or more sections of the concealing undergarment 104 may be formed from the same piece of material. For example, a concealing undergarment 104 may have a front upper portion and a back upper portion that is formed from a single piece of material. Of course, each section may have a different corresponding piece of material in some embodiments. For example, in one embodiment, there may be a first piece of material forming the front 120 and a second piece of material forming the back 128 of the concealing undergarment 104. In another embodiment, individual pieces of materials form the front 120, back 128, upper portion 108, and lower portion 112.

As will be discussed further below, the concealing undergarment 104 may be constructed from a variety of materials. Typically, but not always, the materials will be fabrics or textiles though any material suitable to form an undergarment may be used. The materials will typically be in sheet or panel form and may be attached together in various ways. For example, the materials may be sewn, adhered, or fastened together such as by one or more zippers, buttons, ties, hook and look fasteners, or the like.

The lower portion 112 of the concealing undergarment provides the utility of traditional undergarments while also providing some additional benefits. In one or more embodiments, the lower portion 112 may comprise a breathable crotch section 148, which releases humidity quickly while providing freshness and improving hygiene. This may be accomplished through use of a knit material or a gusset at the crotch section 148. As will be described further below, the lower portion 112 or upper portion 108 may also control the shape of the user's body, such as by lifting, compressing, smoothing, or firming the user's rear or slimming the user's midriff area as desired by the user. Elastic or such similar material may be used.

In one or more embodiments, the upper portion 108 of the concealing undergarment 104 extends upward to cover a portion of the user's torso. The amount the upper portion 108 extends may vary in one or more embodiments. Typically, the upper portion 108 will extend upward at least several inches to conceal the user's abdominal/midriff and lower back area, while hiding rear cleavage. The upper portion 108 may have a tapered, curved, or other shape that allows the upper portion to conform to the user's body. This may be achieved by shaping the front 120 or back 128 of the concealing undergarment 104. For example, as shown in FIGS. 1A and 1B, the front 120 and back 128 taper towards the bottom portion 112.

Figure 2A:
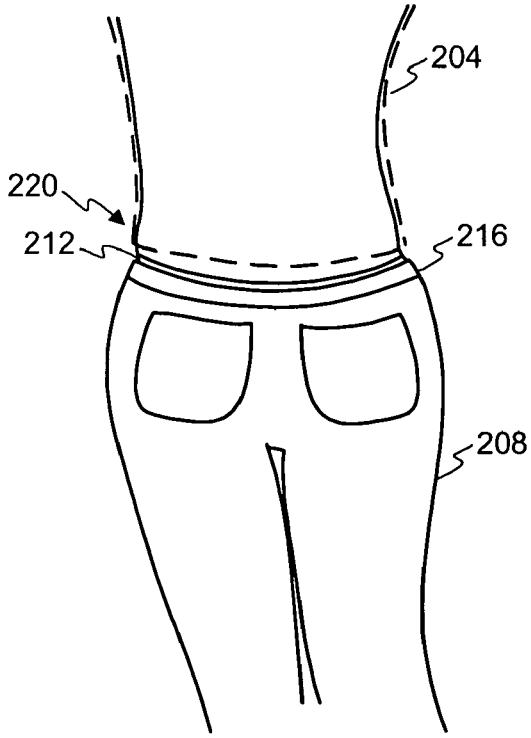
FIG. 2A is a back view of a user without a concealing undergarment.

FIG. 2A illustrates a user wearing a traditional undergarment 212 and jeans 208 or other pants/shorts. As can be seen, the waist 216 of the jeans 208 is insufficient to cover the user's undergarment 212. In addition, the waist 216 is low enough that the user's top 204, such as a shirt, blouse, or sweater, does not extend down far enough to cover the user's undergarment 212. Of course, some tops 204 may have sufficient length to cover the user's undergarment 212, however, as is known, many tops do not. In addition, some tops 204 may only cover the user's undergarment 212 when the user's back is upright, such as when the user is standing or sitting up straight. During daily activities, the position and movement of the user's torso is such that the top 204 cannot conceal the user's undergarment 212 or when wearing bottoms such as the jeans 208 shown.

In addition, portions of the user's back or bottom are also revealed. In some cases, the user may inadvertently or unknowingly be showing rear cleavage. This causes users to be self-conscious, or overly self aware. In addition, the user may experience discomfort and inconvenience in attempting to keep portions of the user's body concealed. In many cases, it is impossible for the user to ensure adequate concealment, especially when the user is moving.

Pressure from the user's undergarment 212 may cause an unwanted bulge 220 to appear. As shown in FIG. 2A for example, the elastic band of the undergarment 212 presses against the user's skin causing the bulge 220 at the user's midsection. The cut of the user's jeans 208 and top 204 allows this bulge 220 to be revealed.

Figure 2B:
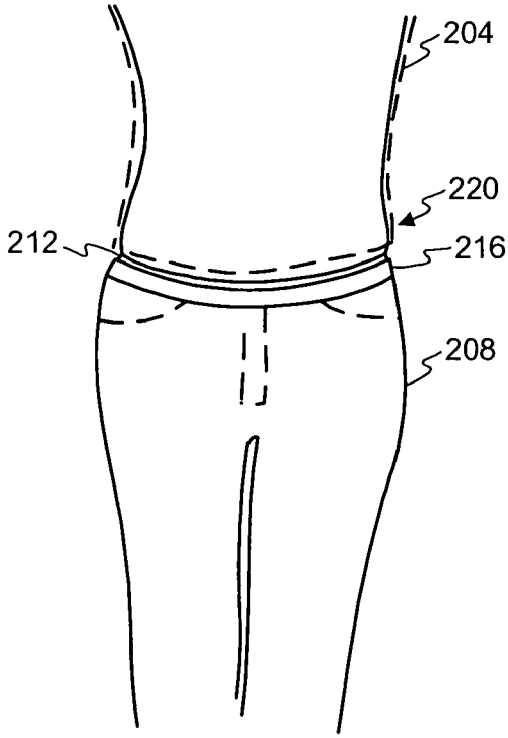
FIG. 2B is a front view of a user without a concealing undergarment.

Likewise, as shown in FIG. 2B, the user's abdominal area is also revealed. In some cases, the appearance of an unwanted bulge 220 or love handles may be created or exacerbated due to the pressure of the waist 216 on the user's body. Because the user's jeans 208 (or other bottoms) and top 204 do not adequately conceal the user's body, these areas can be undesirably revealed. Users may also have one or more aspects of their body which they do not wish others to see. For example, a user may wish to conceal scars or other blemishes as well as stretch marks or cellulite.

Thus, as can be seen users are forced to choose between fashion and comfort/modesty. Of course, one solution is for a user to wear higher-waisted bottoms, longer tops or both. However, this is an undesirable solution if users want to wear a particular style or cut of apparel. As is known, people often want to appear attractive to themselves and to those around them, but also comfortable. Perceived attractiveness, whether true or not, gives people increased confidence in many cases. Thus, allowing users to wear the style of their choice while preserving their modesty and providing comfort is highly advantageous.

Figure 3A:
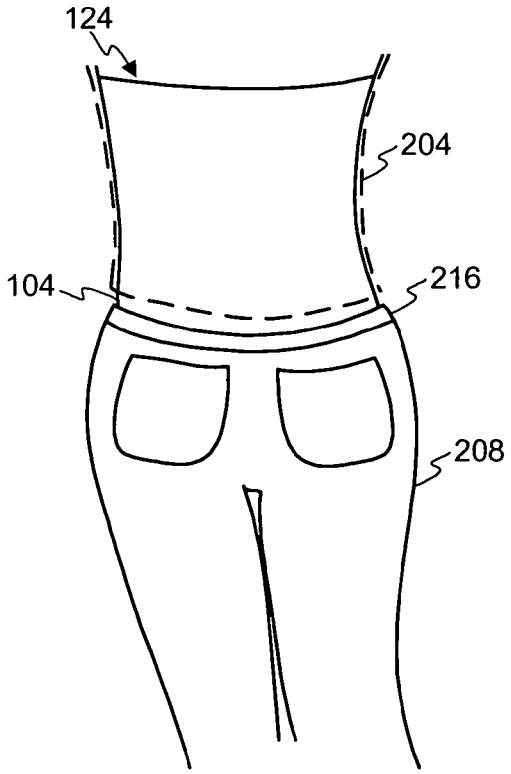
FIG. 3A is a back view of a user wearing an exemplary concealing undergarment.
Figure 3B:
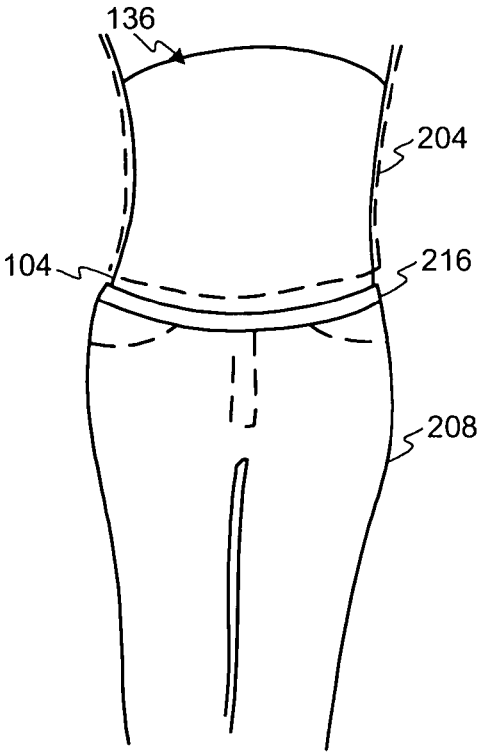
FIG. 3B is a front view of a user wearing an exemplary concealing undergarment.

FIGS. 3A and 3B respectively illustrate a front and back view of a user wearing the concealing undergarment 104 with the same jeans 208 and top 204 as in FIGS. 2A-2B. In one or more embodiments, the concealing undergarment 104 may be formed from or have a portion which, when worn, looks like the user's skin. For example, the concealing undergarment 104 may comprise a sheer, translucent, or nude colored material in one or more embodiments. The concealing undergarment 104 may also be seamless in construction allowing the undergarment to disappear under clothing. In this manner, observers will believe they are seeing a user's skin when they are actually viewing the concealing undergarment 104. In addition, it is contemplated that the concealing undergarment 104 may have one or more portions that are elastic or stretchy in nature thereby causing the fabric to conform and flex with the body.

This is highly beneficial because, the concealing undergarment 104 provides a layer over the user's skin which conceals or hides blemishes, scars, cellulite, stretch marks, excess skin or other aspects of the user's body that the user does not wish to be seen by others. At the same time, the concealing undergarment 104 appears to be the user's skin. Thus, when not fully covered by the user's apparel, the user's skin appears to be flawless. As can be seen from FIGS. 3A and 3B, the concealing undergarment 104 cannot be easily distinguished from the user's body. In this manner, the concealing undergarment 104 appears to be the user's skin.

This is highly advantageous when compared to traditional undergarments, such as shown in FIG. 2A. With the concealing undergarment 104, such as shown in FIG. 3A, it appears as though only the user's skin is revealed. In this manner, the unsightly look of having a portion of one's undergarments exposed, such as in FIG. 2A is prevented. Also, though it appears that a user's skin has been exposed, in reality, only the concealing undergarment 104 has been exposed to view. This preserves the user's modesty and allows the user to go about daily activities without worry about actual skin exposure. In addition, as stated, when the concealing undergarment 104 is revealed, it hides aspects of the user's skin giving the user's skin a flawless appearance.

FIGS. 3A and 3B also show that the concealing undergarment 104 may be form fitting in one or more embodiments. This allows the concealing undergarment 104 look more like the user's skin or not be distinguishable in appearance from the user's skin. The form fitting configuration of the concealing undergarment 104 causes the undergarment to less noticeable to others since it appears as the wearer's skin.

This is advantageous in that it also allows the concealing undergarment 104 to control the shape the user's body. For example, as can be seen in FIGS. 3A and 3B, the concealing undergarment 104 reduces the appearance of bulging at the waist 216 of the user's jeans 208 (or other bottoms). This is accomplished by the form fitting material of the concealing undergarment 104 which hides these areas.

In addition, the undergarment may provide a compressive force which helps smooth or shape the user's figure as the user desires. In one embodiment the concealing undergarment 104 may be configured to control or shape the user's abdominal/midriff area, waist, and rear to allow the user to achieve the user's desired appearance. For example, the user may have a slimmer/firmer appearance by wearing the concealing undergarment 104. The concealing undergarment 104 offers visible results as soon as it is put on.

The concealing undergarment 104 may comprise material of various elastic strengths in one or more embodiments, to allow the undergarment to shape the user's body in this manner. For example, a material of increased elastic strength may be used to provide additional shaping or support, while a material of reduced elastic strength may be used as a less constricting alternative. In one embodiment, a material of increased elastic strength may be configured to support a user's torso or abdominal region to give the user a flatter stomach or a more shapely figure. The concealing undergarment 104 may have portions having different elastic strength to give the user the support desired at location where the user desires. For example, a concealing undergarment 104 may have increased elastic strength near or at the abdominal area if the user desires a flatter stomach or a slimmer look.

It will be understood that a variety of materials, now known or later developed, such as but not limited to nylon, cotton, polyester, spandex, or a combination thereof may be utilized in forming the concealing undergarment 104.

In one or more embodiments, the concealing undergarment 104 may be formed from one or more panels of material. For example, referring to FIGS. 1A and 1B, the concealing undergarment 104 may comprise two panels, a first panel corresponding to the front 120 of the undergarment, and a second panel corresponding to the back 128 of the undergarment. Of course, various panel configurations may be used. For instance there may be a panel for the front upper portion, front lower portion, back upper portion, and back lower portion of the undergarment. In some embodiments, the panels may not be delineated by the portions of the undergarment described herein. For example, in some embodiments, the undergarment may have one or more side panels.

Again, because the concealing undergarment 104 appears to be the user's skin, the concealing undergarment allows the user to control how the user's body appears. Often, users only desire a small amount of support or shaping which may be difficult or impossible to achieve through exercise, and dangerous and expensive to achieve artificially, such as through cosmetic surgery. For example, the user may simply wish only for a slightly more shapely waistline, to reduce the appearance of a little excess abdominal fat, to lift or firm the user's buttocks, or a combination thereof. The concealing undergarment's 104 support or shaping feature allows this to be accomplished safely, easily, quickly, and inexpensively.

Figure 3C:
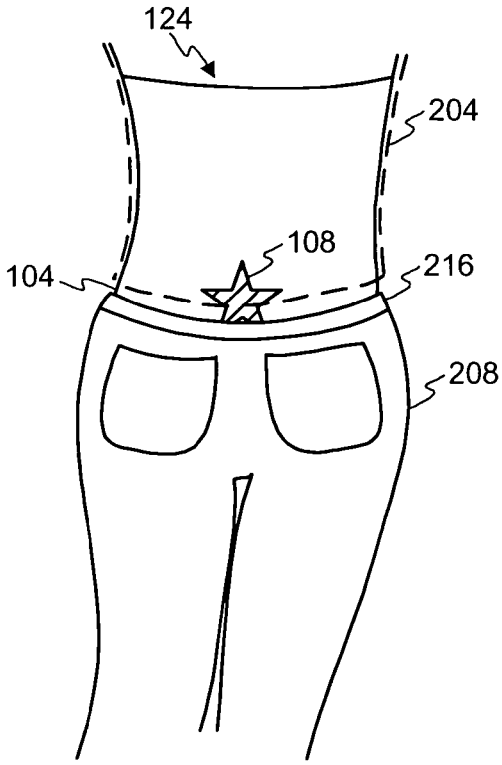
FIG. 3C is a back view of a user wearing an exemplary concealing undergarment having a simulated tattoo.

FIG. 3C illustrates a back view of the concealing undergarment 104 having a simulated tattoo 132 or other design. Because the concealing undergarment 104 appears like skin, the simulated tattoo 132 appears to be a real tattoo. However, the user does not have to endure the pain, cost, or medical risks of getting an actual tattoo. In addition, the user is permitted to change or remove the simulated tattoos as desired simply by wearing a different concealing undergarment 104 with or without the desired simulated tattoo 132 thereon. As a result, The user is also able to avoid the permanence of an actual tattoo. This is advantageous in cases where the user wishes to experience the novelty and self-expression of a tattoo without the permanence of a permanent tattoo. An unexpected surprise for the user's friends/family can be provided by the simulated tattoo 132 as well, without the commitment of a permanent tattoo. It will be understood that the simulated tattoo 132 may be various characters, graphics, symbols, or the like.

The simulated tattoo 132 provides an additional benefit in that it can help conceal portions of the user's body. Because the concealing undergarment 104 may be sheer or somewhat transparent in one or more embodiments, the simulated tattoo 132 may further conceal portions of the user's body. As can be seen in FIG. 3C for example, the simulated tattoo 132 may prevent rear cleavage from being visible. In addition, the pigment simulated tattoo 132 may better conceal scars or other blemishes which may protrude outward from the user's skin.

The simulated tattoo 132 may be selected for its concealing characteristics. For example, the simulated tattoo 132 of FIG. 1A is a butterfly having a body and extended wings. This is beneficial not only because the butterfly is aesthetically pleasing but because its extended/enlarged shape allows it to cover a user's rear cleavage even if the concealing undergarment 104 should shift or move because of a user's movements. Of course, if the undergarment 104 is made from a less shear material, then the undergarment material would provide concealment.

It is noted that more than one simulated tattoo 132 may be provided in various embodiments, and that simulated tattoos 132 may be located at various locations on the concealing undergarment 104. For instance, FIG. 3D shows a simulated tattoo 132 on the front of a concealing undergarment 104. In one or more embodiments, one or more simulated tattoos 132 may be placed at locations which correspond to popular areas for real tattoos.

It is contemplated that simulated tattoos 132 may be provided by a manufacturer or added later by a user. For example, the simulated tattoo may be imprinted by the manufacture or a user may attach, such as by ironing on or printing on, one or more simulated tattoos 132 or their choice. A selection of simulated tattoos 132 may be provided with the concealing undergarment 104. It is contemplated that simulated tattoos 132 may be removable/replaceable in some embodiments. For example, in one embodiment a simulated tattoo 132 may be removably fastened, such as by hook and loop material or temporary glue, to the concealing undergarment 104 and removed or repositioned when desired. In addition, the simulated tattoos may be formed from material which is opaque, when worn or otherwise, to fully conceal the user's body.

Referring back to FIGS. 1A and 1B, the extension 132 of the concealing undergarment 104 will now be described. The extension 132 at the top of the upper portion 108 serves several functions. In one embodiment, the extension 132 provides an elastic binding 144 which prevents the upper portion 108 of the concealing undergarment 104 from slipping or rolling downward. As can be seen, only the extension 132 has an elastic binding 144 and thus the elastic binding only goes around a front portion of the user's torso. The upper portion 108 need not have an elastic binding because the elastic binding 144 on the extension can provide sufficient force to keep the upper portion 108 in position. Of course an elastic binding 144 may be sewn or otherwise attached to the upper portion 108 as well in some embodiments. In these embodiments, one or more elastic bindings may encircle the user.

The extension 132 may be used to prevent the upper portion from slipping or rolling downward. For example, it is contemplated that a portion of the extension 132 may be tucked under a user's bra to hold the upper portion 108 of the concealing undergarment 104 in place. As shown for instance, the extension 132 has a curved shape which is thinner at its upper most section. This allows the extension 132 to be easily and securely tucked under a wearer's bra. In these embodiments it is noted that the concealing undergarment 104 not include an elastic binding 144, however, one may be included to assist in preventing the upper portion 108 from undesirably shifting downward.

It is contemplated that one or more straps, ties, or the like may also extend from the upper portion 108, the extension 132, or both to secure the upper portion in place. It is noted that an extension 132 may not be required in all embodiments, such as for example, in embodiments where straps, ties, or the like extend from the upper portion 108. Alternatively or in addition, the upper portion 108 may have one or more elastic bands to secure the upper portion in position when worn. It is contemplated that one or more symbol areas, as will be described further below, may be located on the upper portion 108. Typically, the symbol areas will be on an internal surface of the upper portion 108 which is adjacent or in contact with the user's skin when the concealing undergarment 104 is worn.

Figure 4A:
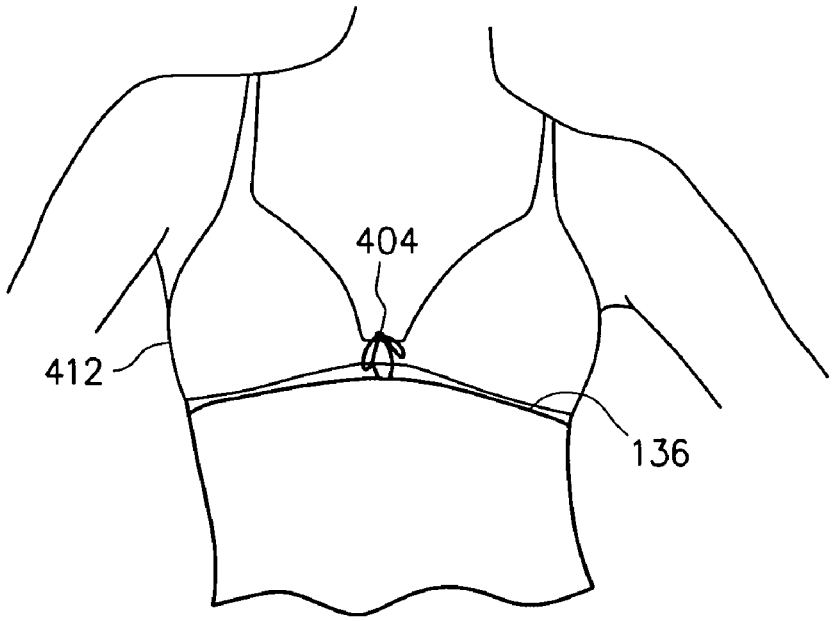
FIG. 4A is a front view of a user wearing an exemplary concealing undergarment with an extension having a tie.
Figure 4B:
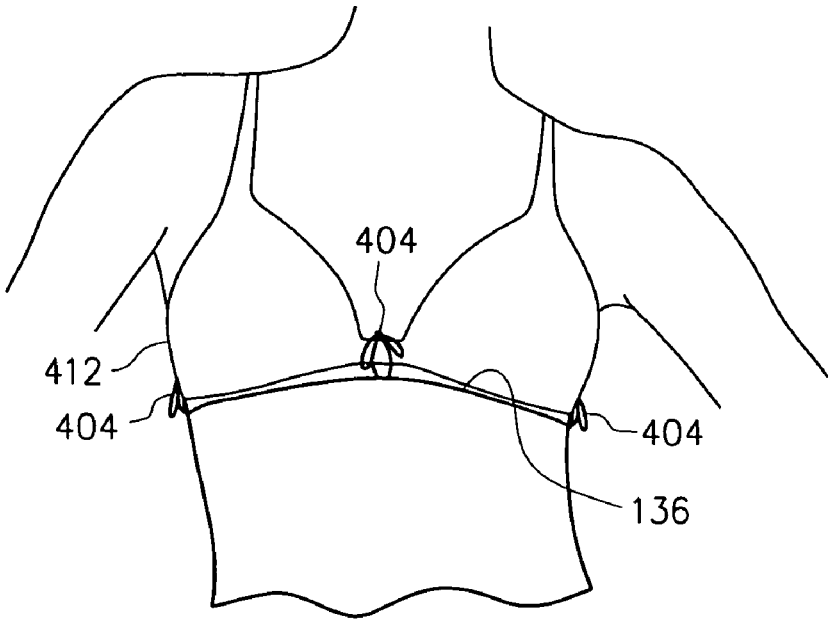
FIG. 4B is a front view of a user wearing an exemplary concealing undergarment with an extension having a plurality of ties.
Figure 4C:
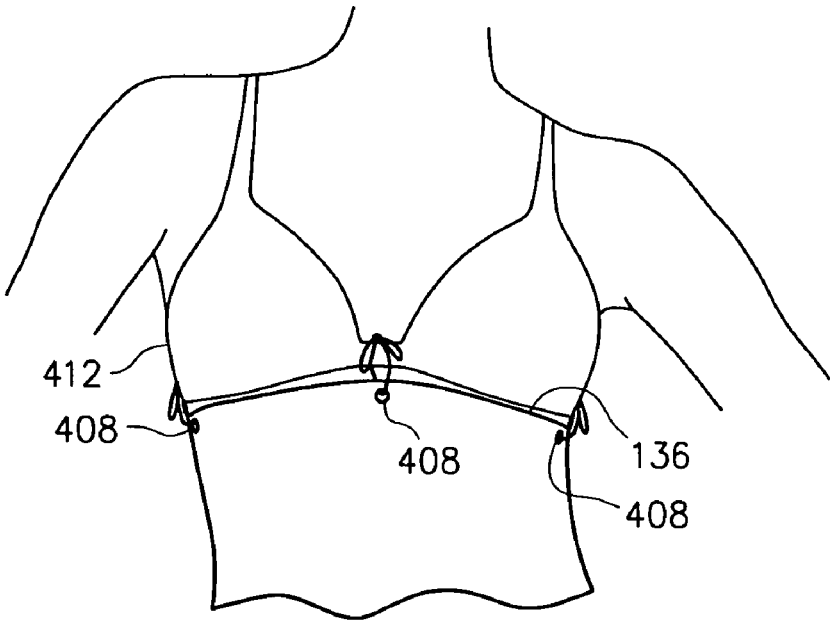
FIG. 4C is a front view of a user wearing an exemplary concealing undergarment with an extension having one or more openings.
Figure 4D:
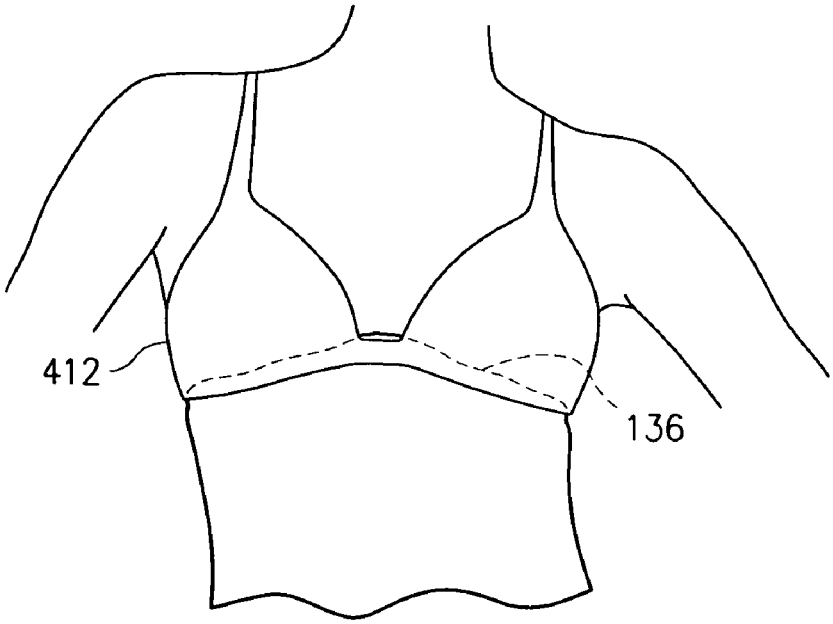
FIG. 4D is a front view of a user wearing an exemplary concealing undergarment with an extension tucked under the user's bra.

The one or more ties may be tied to a user's bra to keep the upper portion 108 in place. FIG. 4A shows an exemplary extension 132 having a single tie 404 which may be tied or otherwise attached to a user's bra 412. FIG. 4B shows an exemplary extension 132 with a plurality of ties 404 which may be attached to the user's bra 412. In addition or alternatively, one or more straps may extend from the concealing undergarment 104 and over the user's shoulders to keep the upper portion 108 in place. In one embodiment, such as shown in FIG. 4C, the extension 132 may have one or more openings 408 to allow the user to optionally use one or more ties or the like to secure the upper portion 108. Of course, ties and openings need not be included in all embodiments. As described above, the extension 136 of the concealing undergarment may be tucked under a user's bra 412. An example of this is illustrated in FIG. 4D.

Figure 1B:
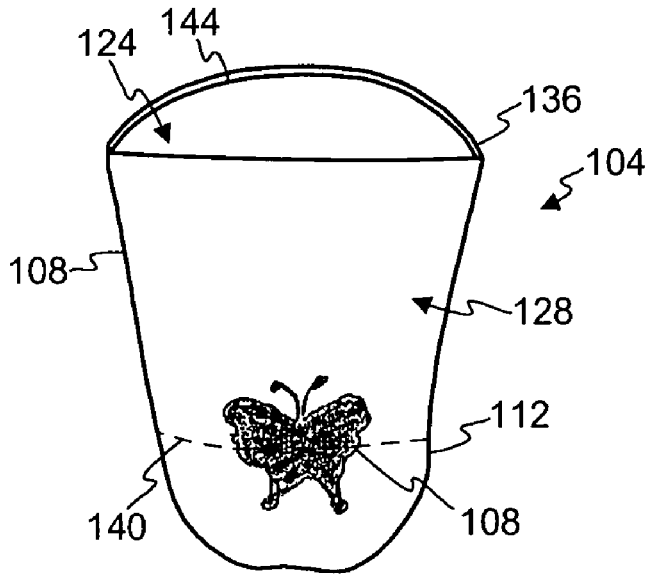
FIG. 1B is a back view of an exemplary concealing undergarment.

The extension 132 may have a variety of shapes in addition to the curved shape illustrated in FIG. 1B. Typically, the extension 132 will narrow as it reaches its top portion such as shown by the curved embodiment. For example, the extension 132 may be triangular or a tapered polygon. Of course, other shapes may be used as well. For instance, the extension 132 may be rectangular.

Figure 5A:
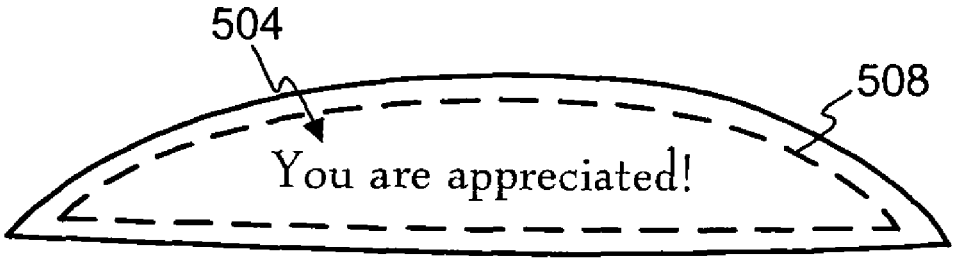
FIG. 5A is a back view of an exemplary symbol area on an extension.
Figure 5B:
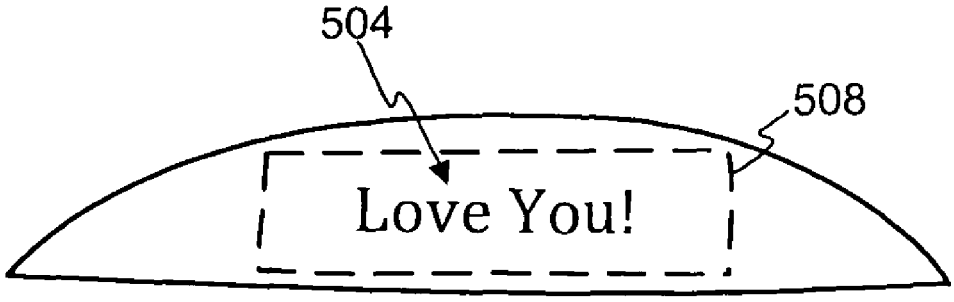
FIG. 5B is a back view of an exemplary symbol area on an extension.

As can be seen in FIGS. 5A and 5B, the extension 132 also comprises an area 504 where one or more symbols 508, such as text, may be printed or otherwise provided. The symbol area 504 may generally conform to the outer shape of the extension 132 or the lower portion of the undergarment. For example, in FIG. 5A, the symbol area 504 is a "D" shape. Of course, the symbol area 504 may be other shapes as well. For example, in FIG. 5B, the symbol area 504 is rectangular in shape. It is contemplated that symbols 508 may be aligned to the shape of the symbol area 504. For example, the symbols 508 may be positioned to follow the curved shape of a symbol area 504.

The one or more symbols 508 may be characters, words, quotes, phrases, graphics, pictures, facts, or the like. In general, the symbols 508 provide inspirational, positive, or encouraging messages to the user. FIGS. 5A and 5B illustrate exemplary embodiments where phrases have been provided on the extension 132.

Typically, the symbol area 504 will be on the back of the extension 132 such that it is in contact with the user's torso when the concealing undergarment 104 is worn. The location of the symbol area 504 on the back of the extension 132 is unique in that it allows the symbols, such as an inspirational quote or phrase, to be viewed by the user when putting on or taking off the concealing undergarment 104. In this manner, the user is inspired and encouraged or can take a moment to reflect, laugh, think, or the like as a result of viewing the symbols when the user gets dressed in the morning or at other times. For example, the user may have a quiet moment of reflection or be invigorated or inspired as a result of seeing the symbols 508 when using the restroom during a hectic or busy day. Also, because of the symbol area's location, the symbol will be close to or tucked next to the wearer's heart when the concealing undergarment 104 is worn. In this manner, the concealing undergarment is in physical contact with a user and can provide positive relief or other psychological benefits to its user who may be in a stressful or negative situation.

It is contemplated that a plurality of phrases, quotes, pictures, graphics or the like may be within the symbol area 504. In this manner, the user does not quickly get bored or the symbols in the symbol area 504. For example, a plurality of phrases may be provided in relatively small type allowing the user to discover new phrases over a period of time. Each concealing undergarment 104 of a set of undergarments may have different phrases to further extend the period of time when the user can discover new phrases. In one or more embodiments, the concealing undergarments 104 may be labeled or otherwise identified as having particular symbols 508. In this way, a user can purchase additional concealing undergarments 104 making sure that each of the concealing undergarments they own comprises different symbols 508.

In one or more embodiments, the symbol area 504 or symbols 508 may be removably fastened to allow different symbols to be used. For example, a first symbol area 504 may be removed from the extension 132 and replaced with another symbol area having one or more different symbols 508 thereon. Removability may be accomplished by one or more removable fasteners such as hook and loop fasteners, buttons, and the like. The symbol area 504 or symbols 508 may also be selected by a user and subsequently attached to the concealing undergarment 104. For example, the symbol area 504 or symbols 508 may be an iron on or the like provided by the manufacturer.

As can be seen the concealing undergarment herein provides numerous psychological and physical benefits which increase confidence during the tasks and responsibilities of daily life. Users of the concealing undergarment will not longer be consumed or preoccupied with constantly adjusting their apparel such as by pulling up their pants and jeans while pulling down their tops to prevent unwanted skin exposure. In this manner, the concealing undergarment offers freedom from embarrassment and self consciousness, and as described above, does so in a playful and stylish way.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. An undergarment comprising:

a front section comprising a bottom portion, an upper portion, and two sides, the bottom portion tapered as compared to the upper portion;

a back section comprising a bottom portion, an upper portion, and two sides, the bottom portion tapered as compared to the upper portion and the bottom portion of the front section and the bottom portion of the back are connected at a bottom end of the undergarment to form a crotch section, wherein the front section and the back section are connected at their sides;

a torso opening configured to accept a torso of a user, the torso opening formed at a top end of the concealing undergarment between the upper portion of the front section and the upper portion of the back section;

a pair of leg openings configured to accept one or more legs of a user, the pair of leg openings formed at a bottom end of the concealing undergarment between the crotch section and the sides of the front section and back section;

an extension comprising a symbol area having one or more symbols thereon, the extension extending upward from the upper portion of the front or back section; and one or more straps extending from the extension, the one or more straps configured to attach to a user's bra to hold the upper portion of the front section and back section in place relative to the user's torso;

a simulated tattoo configured to conceal an area of the user's skin, the simulated tattoo located on the back section;

wherein the back section and front section comprises a material that is sheer, translucent, or a nude colored material, wherein at least one of the front section, back section or extension conceal skin surface of at least a portion of a lower back of a wearer of the undergarment.

2. The undergarment of claim 1 further comprising an elastic binding on the extension, the elastic binding configured to hold the upper portion of the front section and back section in place relative to the user's torso.

3. The undergarment of claim 1, wherein the one or more symbols form one or more sentences.

4. The undergarment of claim 1, wherein the symbol area is on an inner portion of the upper portion of the front section and is viewable by a user when the concealing undergarment is put on or taken off.

5. The undergarment of claim 1, wherein the symbol area is on an inner portion of the extension.

6. The undergarment of claim 1, wherein the simulated tattoo is a silk screened image partially on the back section and partially on the extension.

7. A method of improving the appearance of low-slung apparel with a undergarment comprising:

providing a front section and a back section which are connected at a first side and second side and a bottom, the bottom forming a crotch section, a torso opening formed by the front section and the back section configured to accept a torso of a user, and a pair of leg openings formed by the front section and the back section configured to accept one or more legs of the user;

providing an extension comprising a symbol area having one or more symbols thereon;

providing one or more straps that connect to at least one of the extension, the first section, or the back section;

accepting the user in the undergarment by receiving one or more legs of the user in one or more leg openings of the undergarment, wherein a torso of the user extends out from a torso opening of the undergarment;

presenting one or more symbols on a symbol area to the user, the symbol area located on an extension at a top end of the undergarment, wherein the one or more symbols are presented to a user when performing an action selected from the group consisting of taking off the undergarment and putting on the undergarment;

accepting the user in the low-slung apparel having a top edge;

accepting the user in a top having a bottom edge;

concealing a skin surface of a user's midriff between the top edge and the bottom edge with a first portion of the undergarment, wherein the first portion is sheer, translucent, or nude colored material;

concealing a skin surface of a user's back between the top edge and the bottom edge with a second portion of the undergarment, wherein the second portion is sheer, translucent, or nude colored material; and securing the upper front portion of the undergarment in place by attaching one or more ties extending from the extension to a bra.

8. The method of claim 7 further comprising concealing rear cleavage of the user with one or more simulated tattoos on a back section of the undergarment as the top edge of a low-slung apparel moves downward because of the user's movements.

9. The method of claim 7 further comprising concealing rear cleavage of the user with one or more simulated tattoos on a back section of the undergarment as the bottom edge of a top worn by the user moves upward because of the user's movement.

10. The method of claim 7, wherein the one or more symbols are text phrases.

11. The method of claim 7 further comprising securing the upper front portion of the undergarment in place by tucking the extension under a bra.

12. The method of claim 7 further comprising securing the upper front portion of the undergarment in place with an elastic binding on the extension.

* * * * *